US009625192B1

(12) United States Patent
Briggeman

(10) Patent No.: US 9,625,192 B1
(45) Date of Patent: Apr. 18, 2017

(54) HEAT EXCHANGER WITH INTEGRATED LIQUID KNOCKOUT DRUM FOR A SYSTEM AND METHOD OF COOLING HOT GAS USING A COMPRESSED REFRIGERANT

(71) Applicant: William H. Briggeman, Tulsa, OK (US)

(72) Inventor: William H. Briggeman, Tulsa, OK (US)

( * ) Notice: Subject to any disclaimer, the term of this patent is extended or adjusted under 35 U.S.C. 154(b) by 81 days.

(21) Appl. No.: 14/826,395

(22) Filed: Aug. 14, 2015

Related U.S. Application Data

(60) Provisional application No. 62/038,087, filed on Aug. 15, 2014.

(51) Int. Cl.
*F25B 5/00* (2006.01)
*F25B 5/02* (2006.01)
*F25B 40/02* (2006.01)

(52) U.S. Cl.
CPC ..... *F25B 40/02* (2013.01)

(58) Field of Classification Search
CPC .. F25B 40/02; F25B 1/10; F25B 40/04; F25B 39/04; F25B 2339/041; F25B 2400/16; F25B 45/00; F25B 49/02; F25B 2400/13; F25B 2400/23; F25B 5/00; F25B 5/02; F25B 39/02; F25B 2339/024; F25B 2339/0242
USPC ..... 62/434, 506, 305, 280, 509, 510
See application file for complete search history.

(56) References Cited

U.S. PATENT DOCUMENTS 3,866,427 A * 2/1975 Rothmayer ..... F25B 19/00 236/92 B
3,882,689 A * 5/1975 Rogers ..... F25B 43/00 62/115
4,554,799 A * 11/1985 Pallanch ..... F25B 1/10 417/243
5,069,043 A * 12/1991 Wachs, III ..... F25B 40/02 62/280
5,095,712 A * 3/1992 Narreau ..... F25B 1/10 62/113
5,509,272 A * 4/1996 Hyde ..... F24F 3/153 62/176.5
5,692,389 A * 12/1997 Lord ..... F25B 5/02 62/218
6,023,934 A * 2/2000 Gold ..... H01L 23/445 257/E23.096
6,857,287 B1 * 2/2005 Alsenz ..... F25B 1/00 62/45.1
2001/0037656 A1 * 11/2001 Ross ..... A23G 9/08 62/342
2005/0262870 A1 * 12/2005 Narayanamurthy .. F24F 5/0017 62/434

(Continued)

*Primary Examiner* — Mohammad M Ali
(74) *Attorney, Agent, or Firm* — GableGotwals, Inc.

(57) ABSTRACT

A heat exchanger for cooling gas between compression stages using a compressed refrigerant. The heat exchanger has a pressure vessel with an integrated liquid knockout drum. A finned tube is contained within the pressure vessel. A gas passageway is defined as the volume between the finned tube and the pressure vessel. Refrigerant from a cooling circuit passes through the interior of the finned tube and cools the gas in the gas passageway. Condensate from the cooled gas is removed in the knockout drum. The heat exchangers may also be used in a triple pass cooler.

10 Claims, 3 Drawing Sheets

Single Pass Cooler

(56) References Cited

U.S. PATENT DOCUMENTS

| | | | | |
|---|---|---|---|---|
| 2009/0013702 | A1* | 1/2009 | Murakami | F25B 13/00 62/118 |
| 2012/0174605 | A1* | 7/2012 | Huff | F28D 7/024 62/120 |

* cited by examiner

HEAT EXCHANGER WITH INTEGRATED LIQUID KNOCKOUT DRUM FOR A SYSTEM AND METHOD OF COOLING HOT GAS USING A COMPRESSED REFRIGERANT

PRIORITY CLAIMS

The present Application is a Continuation-In-Part of U.S. Provisional Patent Application No. 62/038,087 filed on Aug. 15, 2014 entitled A Heat Exchanger with Integrated Liquid Knockout Drum for a System and Method of Cooling Hot Gas Using a Compressed Refrigerant, which is incorporated herein by reference.

1. FIELD OF THE INVENTION

The present invention relates generally to a heat exchanger with integrated liquid knockout drum for a system and method for cooling gas.

2. BACKGROUND OF THE INVENTION

During natural gas production the natural gas must be compressed and the excess moisture removed in order to transport it in pipelines. The typical practice is to have multiple compression cycles in series to raise the gas to the pressure of the pipeline being used to transport the gas. Compression introduces heat into the gas. So after each cycle the gas is run through a fin fan heat exchanger. The gas is passed through one of a multiple number of tubes that are in parallel between two headers. Ambient air is then forced over the exterior of the tubes. Heat from the gas is transferred through the tube and the fins located on the exterior surface of the tube and into the ambient air. Once cooled, the excess water and other liquids are removed from the gas prior to beginning another compression cycle.

The number of compression cycles can vary depending upon the pressure of the pipeline being used to transport the gas, gas specifications and average summer ambient air temperatures for the location.

The drawback to the prior art system is the efficiency of heat removal. The fin fan heat exchangers are expensive to install and operate. The movement of large amounts of ambient air across the exterior of the tubes is exceedingly loud.

What is needed, therefore, is a more cost effective, efficient and quiet way to cool gas between compression cycles.

BRIEF SUMMARY OF THE INVENTION

The present invention achieves its objections by providing a heat exchanger with an integrated liquid knockout drum for an efficient method and system for cooling natural gas and other gases between compression cycles. The heat exchanger has a pressure vessel with a hot gas inlet at the first end, a cool gas outlet at the second end, an integrated liquid knockout drum at the second end and a finned tube extending through the center of the vessel. A hot gas passageway is formed between the interior of the pressure vessel and the finned tube. As the gas moves through the hot gas passageway, heat from the gas is passed through the finned tube into a compressed refrigerant running through a separate parallel passageway, namely the center passageway of the finned tube. Condensate from the cooled gas is collected in the bottom of the knockout drum. The liquids can be captured. The marketable constituents may be separated and sold with the remainder disposed of in accordance with industry practices. The cooled gas exits through the heat exchanger. From there, the cooled gas may enter another compression cycle after which it might go through another cooling cycle. Alternatively, the cooled gas may be used in various processes or entered into a pipeline for transportation.

The present invention could be used to cool between compression stages resulting in cooler suction temperatures regardless of the ambient temperature. Cooler suction temperature results in more efficient compressor operation with less maintenance and stress on the compressor.

The present invention could also be incorporated into a vapor recovery unit to protect the compressor from liquids and removing the liquids to be sold in the market. It could also be used to remove liquids from a natural gas collection system. This would keep the liquids from clogging pipelines thus reducing and possibly eliminating the need for pigging.

Yet another possible applications for the present invention is to dehydrate and clean up natural gas that otherwise would be flared or vented. The resulting gas could be used to generate electricity or compressed to be used as fuel to run engine driven pump jacks or drilling equipment.

Thus, the present invention provides an efficient alternative to the use of traditional air to air fin fan heat exchanger for cooling various gases between compression cycles. The present invention is less capital intensive to install. It is also more economical to operate. Further, the footprint of the present invention's system is significantly smaller than the traditional cooling equipment.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION

Figure 1:
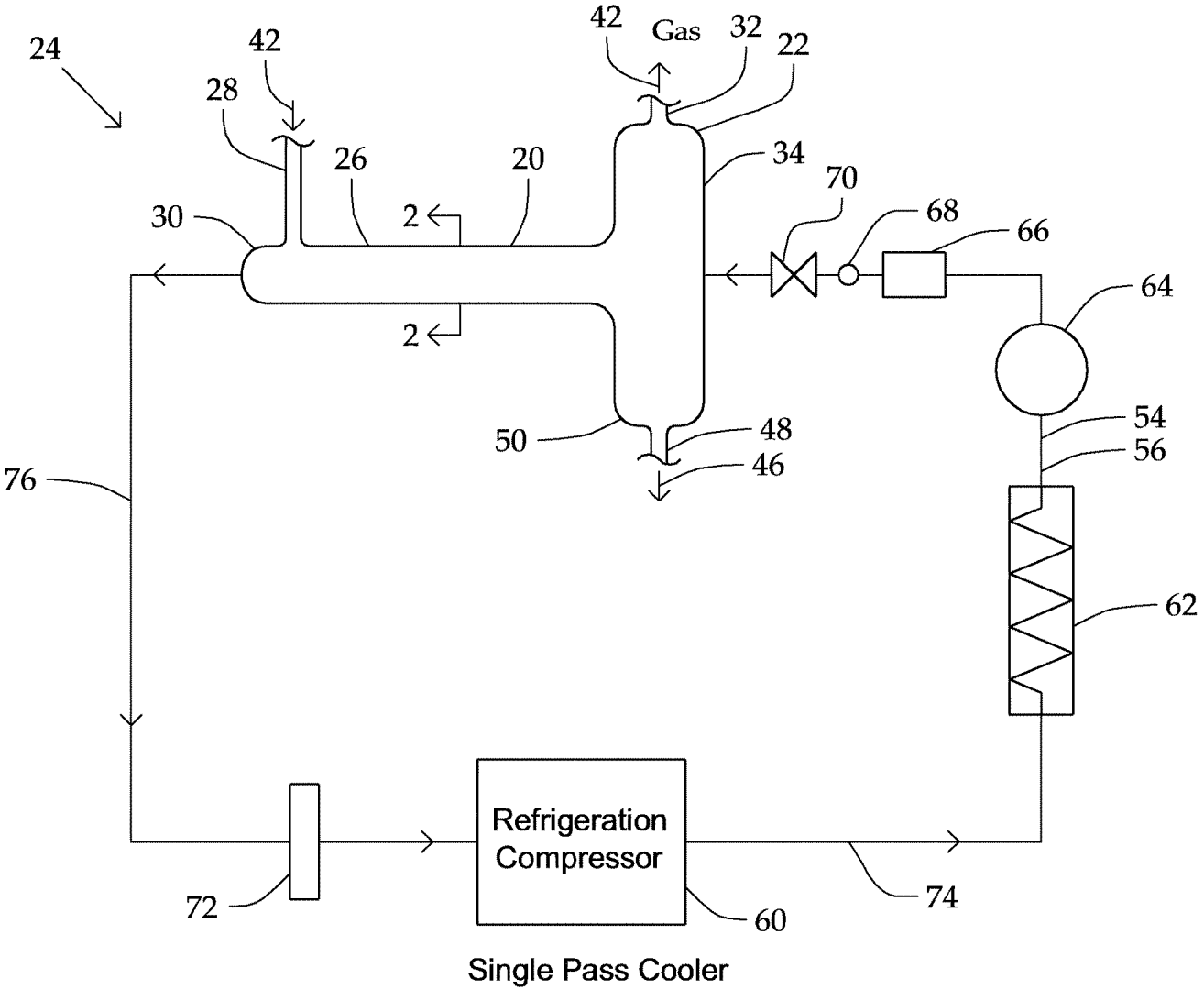
FIG. 1 is a schematic view of the current invention.
Figure 2:
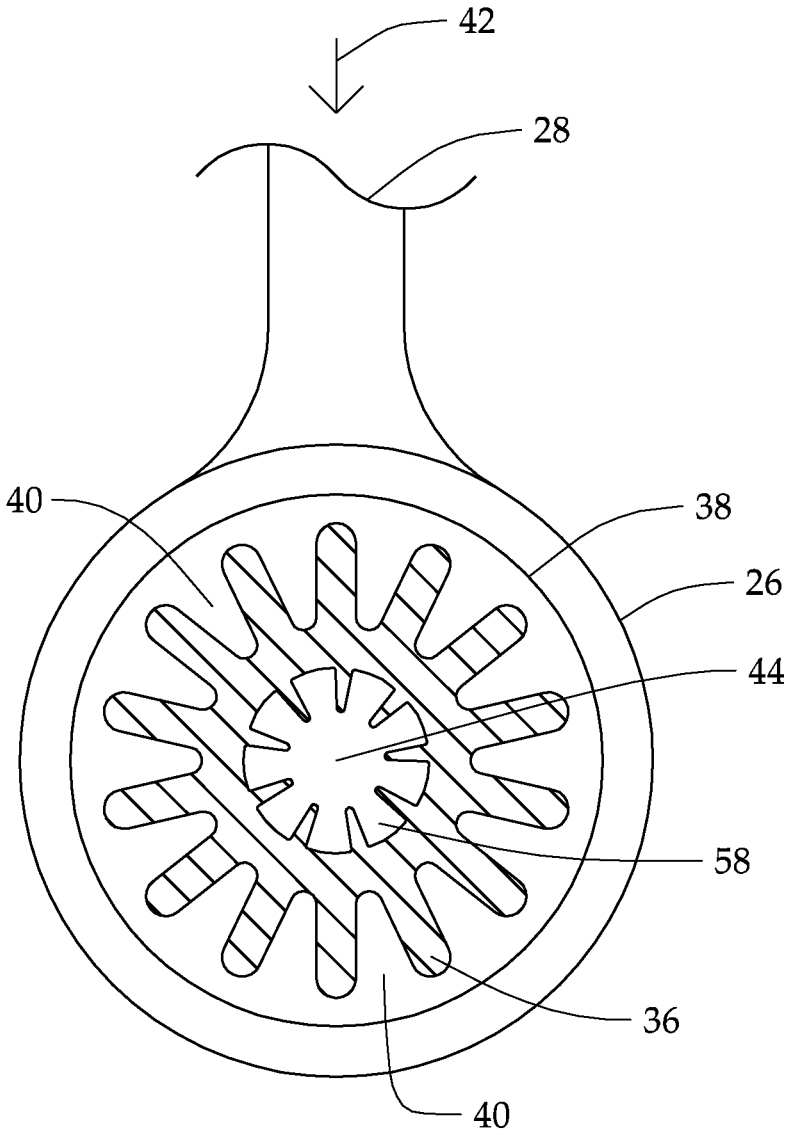
FIG. 2 is a cross-sectional view of the pressure vessel.
Figure 3:
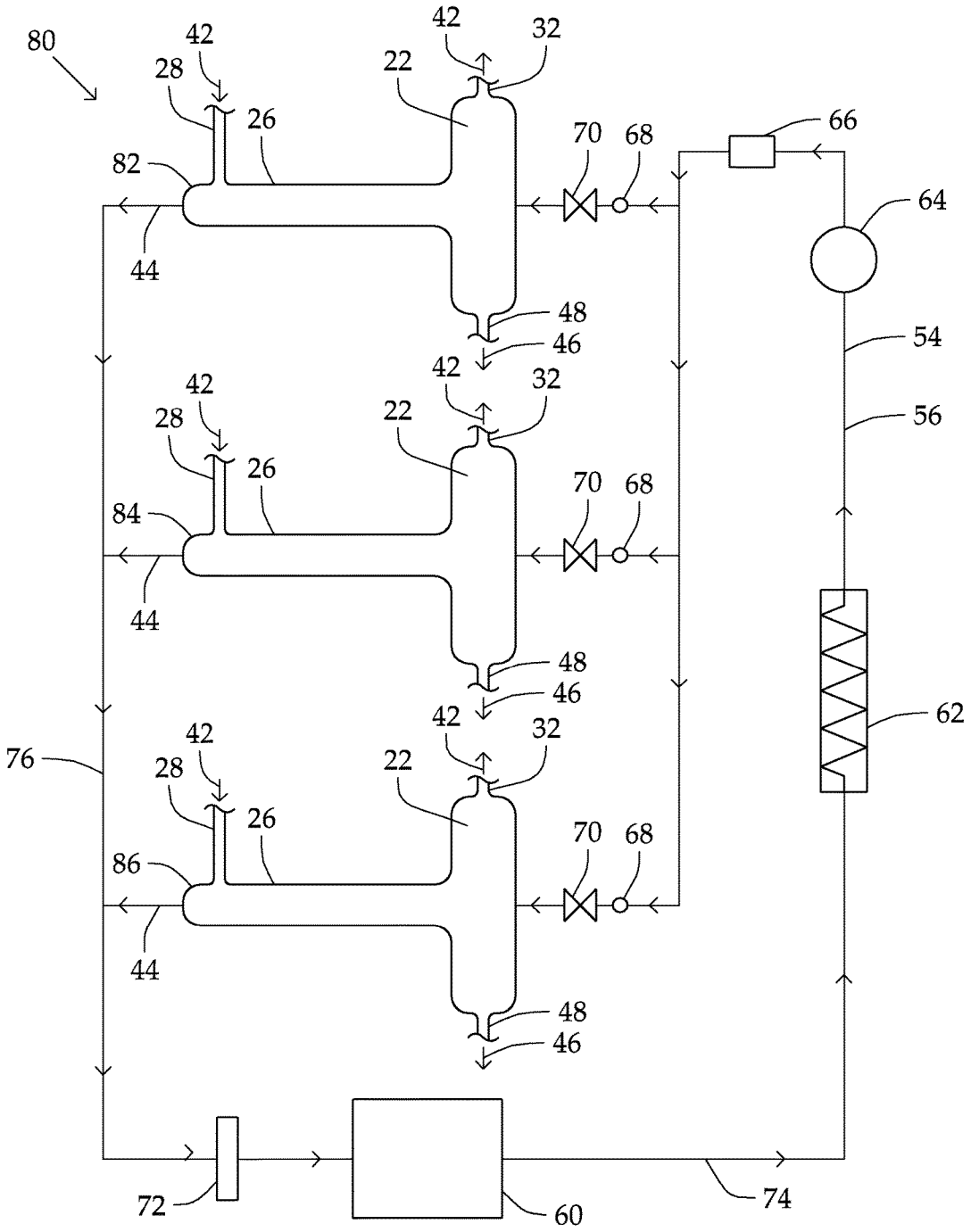
FIG. 3 is a schematic view of the current invention in a three pass configuration.

Turning now to FIGS. 1-3, the preferred embodiment of the present invention is a heat exchanger 20 with an integrated liquid knockout drum 22 for an efficient method and system 24 for cooling natural gas and other gases 42 between compression cycles. The heat exchanger 20 has a pressure vessel 26 with a hot gas inlet 28 at the first end 30, a cool gas outlet 32 at the second end 34, an integrated liquid knockout drum 22 at the second end 34 and contained within the pressure vessel. A finned tube 36 extends through the interior 38 of the vessel 26. A hot gas passageway 40 is formed between the interior 38 of the pressure vessel 26 and the finned tube 36. As the gas 42 moves through the hot gas passageway 40, heat from the gas is passed through the finned tube 36 into the refrigerant 44.

The cooled gas 42 cannot hold as much moisture as the hot gas 42 so liquid or condensate 46 forms as the gas 42 moves through the hot gas passageway 40. This condensate 46 drops out of the cooled gas 42 and is removed through the liquid outlet 48 at the bottom 50 of the knockout drum 22.

The liquids 46 removed vary depending upon the gas 42 being treated. They typically contain water and/or natural gas liquids. The liquids 48 may be captured or discarded. The marketable constituents may be separated and sold with the remainder disposed of in accordance with industry practices. The cooled gas 42 exits through the cool gas outlet. From there the cooled gas 42 may enter another compression cycle 52 after which it might go through another cooling cycle 54. Alternatively the cooled gas 42 may be used in various processes or entered into a pipeline for transportation.

A cooling circuit 56 passes through the interior 58 of the finned tube 36 separate from the hot gas. The cooling circuit 56 is comprised of a compressor 60 which compresses the refrigerant 44. The compressed refrigerant 44 passes through a condenser 62 which removes heat from the compressed refrigerant 44. The refrigerant 44 then passes through a receiver 64, liquid line filter 66, site glass 68 and an expansion valve 70 prior to passing through the interior 58 of the finned tube 36, also referred to as the refrigerant passageway 58 in the finned tube 36. As the refrigerant 44 passes through the refrigerant passageway 58 of the finned tube 36, heat is transferred from the hot gas 42, through the finned tube 36 and into the refrigerant 44. The refrigerant 44 then flows through an accumulator 72 and back to the refrigeration compressor 60 to repeat the cooling circuit 56. As can be seen in FIG. 1, in the preferred embodiment, the refrigerant 44 enters the vessel 26 from the opposite end as the hot gas 42 being cooled. Thus, the refrigerant 44 flows in the opposite direction as the gas 42 being cooled.

Various types of refrigerant 44 may be used. The high side 74 being from the compressor 60 to the expansion valve 70 as the refrigerant 44 flows. The low side 76 being from the expansion valve 70 back to the compressor 60 as the refrigerant 44 flows. The operating pressures, temperatures and refrigerants may be varied to address different operating criteria. Further, operating temperatures and pressures may vary as a result of conditions and the process used.

The preferred embodiment of the heat exchanger 20 with integrated liquid knockout drum 22, has a horizontally-oriented, generally cylindrically shaped, heat exchange chamber 78 containing the finned tube 36 extending through the interior 38 of the heat exchange chamber 78 from the gas inlet 28 to the knockout drum 22. The heat exchange chamber 78 is in fluid communication with the integrated liquid knockout drum 22. The knockout drum 22 is contained within the pressure vessel 26. The liquid knockout drum 22 is a vertically oriented chamber extending above and below the heat exchanger chamber 78 with a liquid outlet 48 at the bottom 50 and a gas outlet 32 at the top.

FIG. 3 shows the heat exchanger 20 of the present invention in a triple pass system 80. Here a single cooling circuit 56 provides refrigerant 44 to a first, second and third heat exchanger 82, 84 and 86. The cooling circuit 56 and each of the three heat exchangers 82, 84 and 86 are constructed and operate in the same manner as the heat exchanger 20 in FIGS. 1 and 2 described above.

One application for the triple pass system 80 shown in FIG. 3 would be to cool gas 42 for two cycles of compression. The gas 42 would be cooled in the first heat exchanger 82 prior to being compressed the first time. Following the first compression cycle the gas 42 would be cooled a second time in the second heat exchanger 84. Following the second cooling cycle the gas 42 would be compressed a second time. The gas 42 would then be cooled a third time by the third heat exchanger 86. In addition to cooling the gas 42 at each of these cooling cycles, excess condensate 46 would be removed from the gas 42 through the knockout drum 22 of each of these three heat exchangers 82, 84 and 86.

In testing of the present invention, an injection machine producing 500,000 (350 cfm) cubic feet per day of gas 42 with a composition of approximately 85% nitrogen and 15% carbon dioxide (specific gravity of 1.05 and mole weight of 30.419) at 148 degrees with 1.85" of water column pressure with a relative humidity of 97% was fed to a first heat exchanger 82 of a triple pass system 80. The output of the first cooling stage or heat exchanger 82 was 70 degrees at the suction to the first stage of compression. The discharge of the first stage of compression was 30 PSI at 294 degrees. This was fed into the second heat exchanger 84, which lowered the temperature of the gas 42 to 74 degrees. The gas 42 was then compressed a second time to 150 psi at 289 degrees. The gas 42 then entered the third heat exchanger 86. Following the third cooling cycle the gas 42 was at 64 degrees and 16% relative humidity. In total the triple pass system 80 had dropped the gas 523 degrees of temperature in three stages knocking out 81% humidity with 192,202.5 BTU/hr or approximately 16 tons of cooling.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A heat exchanger for cooling gas and liquids between compression stages, said heat exchanger comprising:
- a pressure vessel having a gas inlet located on a first end and a gas outlet located on a second end;
- a knockout drum perpendicular to the pressure vessel and in fluid communication with the pressure vessel;
- a finned tube with an interior, the finned tube located inside the pressure vessel and defining a gas passageway between the finned tube and the pressure vessel;
- a cooling circuit in fluid communication with the interior of the finned tube;
- a gas located in the gas passageway; and
- refrigerant located in the cooling circuit and the interior of the finned tube.

2. The heat exchanger of claim 1, the cooling circuit further comprising:
- a compressor;
- a condenser;
- a receiver;
- a filter;
- a site glass;
- an expansion valve; and
- an accumulator.

3. The heat exchanger of claim 2, the refrigerant comprising R404A.

4. The heat exchanger of claim 3, further comprising:
- a low side on the cooling circuit located between the expansion valve and compressor; and
- a high side on the cooling circuit located between the compressor and the expansion valve.

5. The heat exchanger of claim 1, further comprising the gas and the refrigerant running in opposite directions.

6. A heat exchanger for cooling gas and liquids between compression stages, said heat exchanger comprising:
- a pressure vessel having a gas inlet located on a first end and a gas outlet located on a second end;

a knockout drum perpendicular to the pressure vessel and in fluid communication with the pressure vessel;

a finned tube with an interior, the finned tube located inside the pressure vessel and defining a gas passageway between the finned tube and the pressure vessel;

a cooling circuit in fluid communication with the interior of the finned tube, the cooling circuit having a compressor, a condenser, a receiver, a filter, a site glass, an expansion valve and an accumulator;

a high side located in the cooling circuit between the compressor and the expansion valve;

a low side located in the cooling circuit between the expansion valve and the compressor;

refrigerant located in the cooling circuit and the interior of the finned tube; and a gas located in the gas passageway.

7. A heat exchanger for cooling gas and liquids between compression stages, said heat exchanger comprising:

a first, a second, and a third heat exchanger, each heat exchanger having a pressure vessel having a gas inlet located on a first end and a gas outlet located on a second end, a finned tube with an interior, the finned tube located inside the pressure vessel and defining a gas passageway between the finned tube and the pressure vessel;

a cooling circuit in fluid communication with the interior of the finned tube of each pressure vessel;

each pressure vessel containing a knockout drum perpendicular to the finned tube of the pressure vessel and in fluid communication with the pressure vessel;

a gas located in the gas passageway; and refrigerant located in the cooling circuit and the interior of the finned tube.

8. The heat exchanger of claim 7, the cooling circuit further comprising:

a compressor;

a condenser;

a receiver;

a filter;

a site glass;

an expansion valve; and an accumulator.

9. The heat exchanger of claim 8, the refrigerant comprising R404A.

10. The heat exchanger of claim 7, further comprising:

a low side on the cooling circuit located between the expansion valve and compressor; and a high side on the cooling circuit located between the compressor and the expansion valve.

* * * * *